US005187146A

United States Patent [19]

Ficcaglia et al.

[11] Patent Number: 5,187,146

[45] Date of Patent: Feb. 16, 1993

[54] METHOD FOR INCREASING ADHESION OF SPACER BEADS ON A DYE-DONOR OR DYE-RECEIVING ELEMENT FOR LASER-INDUCED THERMAL DYE TRANSFER

[75] Inventors: Linda I. Ficcaglia, Geneva; Mark P. Guittard; Stephen M. Neumann, both of Rochester, all of N.Y.

[73] Assignee: Eastman Kodak Company, Rochester, N.Y.

[21] Appl. No.: 799,473

[22] Filed: Nov. 26, 1991

[51] Int. Cl.[5] ..... B41M 5/035; B41M 5/38

[52] U.S. Cl. ..... 503/227; 427/146; 427/372.2; 428/195; 428/323; 428/913; 428/914

[58] Field of Search ..... 8/471; 427/146, 372.2; 428/195, 323, 913, 914; 503/227

[56] References Cited

U.S. PATENT DOCUMENTS 4,772,582 9/1988 DeBoer ..... 503/227

4,876,235 10/1989 DeBoer ..... 503/227

*Primary Examiner*—B. Hamilton Hess

*Attorney, Agent, or Firm*—Harold E. Cole

[57] ABSTRACT

This invention relates to a process for increasing the adhesion of spacer beads on a dye-donor or dye-receiver element for use in a laser-induced thermal dye transfer system comprising:

a) coating a support with either:

1) a dye layer in a polymeric binder having an infra-red absorbing material associated therewith, or 2) a dye image-receiving layer; the dye layer or the dye image-receiving layer also having spacer beads located either in the layer or in a polymeric over-coat layer; and b) heating the element at a temperature above the glass transition temperature of the dye layer or dye image-receiving layer while under tension.

7 Claims, No Drawings

METHOD FOR INCREASING ADHESION OF SPACER BEADS ON A DYE-DONOR OR DYE-RECEIVING ELEMENT FOR LASER-INDUCED THERMAL DYE TRANSFER

This invention relates to a method for increasing adhesion of spacer beads on a dye-donor or dye-receiver element used in a laser-induced thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

Spacer beads may be employed in a separate layer over the dye layer of the dye-donor in the above-described laser process in order to prevent sticking of the dye-donor to the dye-receiver during dye transfer, and also to increase the uniformity and density of the transferred image. That invention is more fully described in U.S. Pat. No. 4,772,582, the disclosure of which is hereby incorporated by reference.

Alternatively, the spacer beads may be employed in the polymeric dye image-receiving layer of the dye-receiver in the above-described laser process as described in U.S. Pat. No. 4,876,235, the disclosure of which is hereby incorporated by reference.

There is a problem with using spacer beads in the laser dye transfer system described above in that there is a lack of adequate adhesion of the beads to the element. Even if adhesive materials such as emulsion polymers of vinyl acetate are used to adhere the beads, normal handling or even light surface wiping will remove substantial quantities of beads. Loss of beads can cause several problems. The dislodged beads act as dirt and can cause problems with the laser printer. Random sticking of the donor to the receiver may also occur when there are insufficient beads in an area to prevent contact between the dye-donor and dye-receiver.

Normally when a dye-donor or dye-receiver element for laser-induced thermal dye transfer is coated, a hopper-type apparatus with a heating section is used to coat solutions of controlled viscosity. The wet-coated web then passes through a drying section but is generally cooled to near room temperature before the coated web is wound up on a spool. Such conditions result in inherently poor bead adhesion. The use of higher levels of binder adhesive is impractical since it produces lowered transferred density.

It would be desirable to provide a way to improve the adhesion of the beads which are used in a dye-donor or dye-receiver element for the production of a laser-induced thermal dye transfer image.

These and other objects are achieved in accordance with this invention which relates to a process for increasing the adhesion of spacer beads on a dye-donor or dye-receiver element for use in a laser-induced thermal dye transfer system comprising:

a) coating a support with either:

1) a dye layer in a polymeric binder having an infrared absorbing material associated therewith, or 2) a dye image-receiving layer; the dye layer or the dye image-receiving layer also having spacer beads located either in the layer or in a polymeric overcoat layer; and b) heating the element at a temperature above the glass transition temperature of the dye layer or dye image-receiving layer while under tension.

The element may be dried before the heating step b) described above, or drying could also take place during the heating step.

By using the invention, the adhesion of the beads on the dye-donor is greatly improved while maintaining the function of the beads in the laser dye transfer process.

Heating at any temperature above the glass transition temperature, $T_g$, of the polymeric layer is suitable for the process of the invention. In general, a temperature of about 10°–20° C. above the glass transition temperature has been found to give good results.

The tension under which the coated web is placed while heating is not critical. In general, good results have been found at a tension of about 350g/cm$^2$ to about 2500g/cm$^2$. Tension may also be supplied by using a nip roller in a drying section. However, it is necessary for the invention that the heating of the dye layer or dye image-receiving layer be above the glass transition temperature while the element is simultaneously under tension. Using tension while drying at room temperature, or heating the element above the glass transition temperature with the element not being under tension is ineffective.

The spacer beads employed in the invention have such a particle size and concentration so that effective contact between the dye-donor and dye-receiver is prevented during the laser-induced thermal dye transfer process.

Any spacer beads may be employed in the invention provided they have the particle size and concentration as described above. In general, the spacer beads should have a particle size ranging from about 3 to about 100 μm, preferably from about 5 to about 50 μm. The coverage of the spacer beads may range from about 50 to about 100,000 beads/cm$^2$. In a preferred embodiment of the invention, the spacer beads have a particle size of from about 5 to about 50 μm and are present at a concentration of from about 60 to about 60,000/cm$^2$. The spacer beads do not have to be spherical and may be of any shape.

The spacer beads may be formed of polymers such as polystyrene, phenol resins, melamine resins, epoxy resins, silicone resins, polyethylene, polypropylene, polyesters, polyimides, etc.; metal oxides; minerals; inorganic salts; organic pigments; etc. In general, the spacer beads should be inert and insensitive to heat at the temperature of use.

If the spacer beads are used in a separate overcoat layer of the dye-donor or dye-receiver, they are used with a polymeric binder such as higher polysaccharides, e.g., starch, dextran, dextrin, corn syrup, etc.; cellulose derivatives; acrylic acid polymers; polyesters; polyvinylacetate; etc. The binder should be dye-permeable and insoluble to the spacer beads. In general, good results have been obtained at a concentration of about 0.002 to about 0.2 g/m$^2$.

To obtain the laser-induced thermal dye transfer image employed in the invention, a diode laser is preferably employed since it offers substantial advantages in terms of its small size, low cost, stability, reliability, ruggedness, and ease of modulation. In practice, before any laser can be used to heat a dye-donor element, the element must contain an infrared-absorbing material, such as carbon black, cyanine infrared absorbing dyes as described in U.S. Pat. No. 4,973,572, or other materials as described in the following U.S. Pat. Nos.: 4,948,777, 4,950,640, 4,950,639, 4,948,776, 4,948,778, 4,942,141, 4,952,552 and 4,912,083 and U.S. application Ser. Nos.: 366,952, 369,493, 369,492, and 369,491, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. The infrared-absorbing material may be contained in the dye layer itself or in a separate layer associated therewith.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses the laser described above to form an image on a thermal print medium is described and claimed in copending U.S. application Ser. No. 451,656 of Baek and DeBoer, filed Dec. 18, 1989, the disclosure of which is hereby incorporated by reference.

Any dye can be used in the dye-donor employed in the invention provided it is transferable to the dye-receiving layer by the action of the laser. Especially good results have been obtained with sublimable dyes such as anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

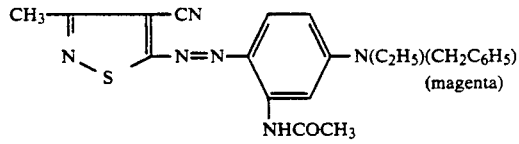

(magenta)

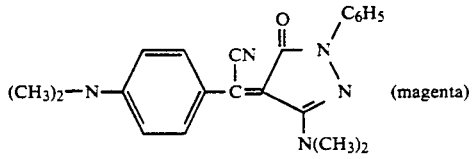

(magenta)

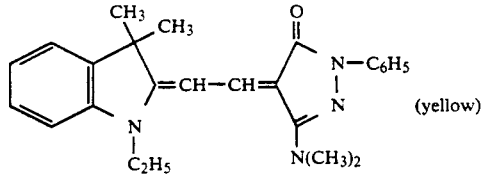

(yellow)

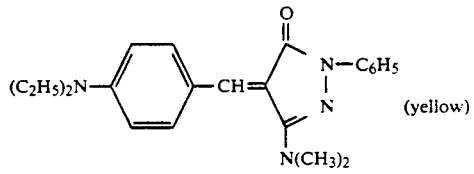

(yellow)

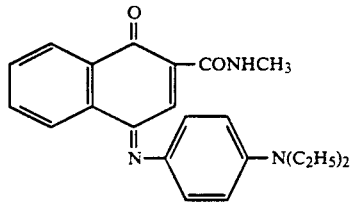

(cyan)

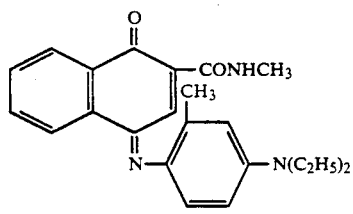

(cyan)

or any of the dyes disclosed in U.S. Pat. Nos. 4,541,830, 4,698,651, 4,695,287, 4,701,439, 4,757,046, 4,743,582, 4,769,360, and 4,753,922, and the disclosures of which are hereby incorporated by reference. The above dyes may be employed singly or in combination. The dyes may be used at a coverage of from about 0.05 to about 1 g/m$^2$ and are preferably hydrophobic.

The dye in the dye-donor employed in the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; polyvinyl acetate, poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element employed in the invention provided it is dimensionally stable and can withstand the heat of the laser. Such materials include polyesters such as poly(ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 5 to about 200 um. It may also be coated with a subbing layer, if desired, such as those materials described in U.S. Pat. Nos. 4,695,288 or 4,737,486.

The dye-receiving element that is used with the dye-donor element employed in the invention comprises a support having thereon a dye image-receiving layer. The support may be glass or a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

A process of forming a laser-induced thermal dye transfer image using the elements prepared by the invention comprises:

a) contacting at least one dye-donor element as described above, with a dye-receiving element as described above;
b) imagewise-heating the dye-donor element by means of a laser; and
c) transferring a dye image to the dye-receiving element to form the laser-induced thermal dye transfer image.

The following examples are provided to illustrate the invention.

EXAMPLE 1

A cyan dye-donor element was prepared by coating the following layers on a 100 μm unsubbed poly(ethylene terephthalate) support:

a) a layer containing the cyan image dyes illustrated above (each at 0.41 g/m$^2$) and infrared absorbing dye illustrated below (0.14 g/m$^2$) in a cellulose acetate propionate binder (2.5% acetyl, 46% propionyl) (0.41 g/m$^2$) coated from a dichloromethane and 1,1,2 trichloroethylene solvent mixture; and
b) an overcoat of a water suspension of polystyrene beads (average particle size 8 μm) (0.047 g/m$^2$), a nonylphenolglycidol surfactant, 10G, (Olin Matheson Corp.) in a "white glue" binder of a water based emulsion polymer of vinyl acetate, Wood-Lok® 40-0212 (National Starch Co.) (0.047 g/m$^2$).

The above dye-donor had a measured $T_g$ of 86° C. for the polymer containing the dye. Other dye-donor elements were prepared as described above, but without using any "white glue" in the coating as a bead adhesive.

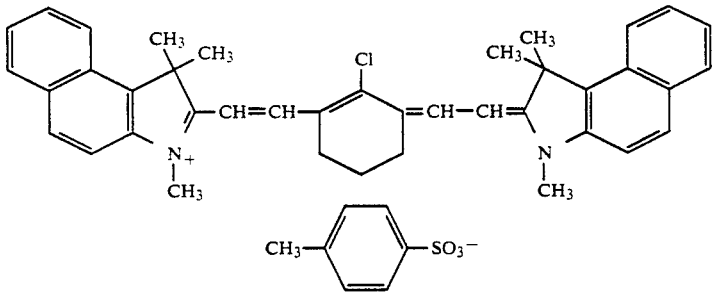

Cyanine Infrared Absorbing Dye

During the coating of each overcoat, the drying section adjacent to the hopper was maintained at 94° to 121° C. The coating speed was the same so that the contact time of the web during drying was the same. Tension applied during the winding operation was also kept constant. Variations were made in the temperature during the winding operation as shown below.

Bead retention was evaluated using a low power magnifier by first counting the beads in a given area, then wiping the surface of the dye-donor three times with a tissue paper covered glass rod and again counting the remaining beads in the same area. The results were classified into the following categories:

E- Excellent bead retention (at least 80% of the beads were retained)

M- Moderate bead retention (30–80% of the beads were retained)

P- Poor bead retention (less than 30% of the beads were retained)

The following results were obtained:

| Coating $T_g$ (°C.) | Winding Temperature (°C.) | Binder for Beads | Bead Retention |
|---|---|---|---|
| 86 | 27 | yes | P |
| 86 | 43 | yes | P |
| 86 | 66 | yes | P |
| 86 | 105 | yes | E |
| 86 | 27 | no | P |
| 86 | 105 | no | E |

The above results indicate that winding the coated web under tension at a temperature above the $T_g$ of the dye-polymer layer gave improved bead adhesion.

EXAMPLE 2

Cyan dye-donor elements were prepared as described in Example 1 except that Butvar 76® polyvinyl alcohol-butyral (Monsanto Corp.) (0.41 g/m$^2$) was used as the dye-donor binder in place of cellulose acetate propionate. The coating conditions, drying conditions and temperature variations during winding were as described in Example 1. The following results were obtained:

| Coating $T_g$ (°C.) | Winding Temperature (°C.) | Bead Retention |
|---|---|---|
| 55 | 43 | M |
| 55 | 105 | E |

The above results again indicate that winding the coated web under tension at a temperature above the $T_g$ of the dye-polymer layer gave improved bead adhesion.

The invention has been described in detail with particular reference to preferred embodiments thereof, but it will be understood that variations and modifications can be effected within the spirit and scope of the invention.

What is claimed is:

1. A process for increasing the adhesion of spacer beads on a dye-donor or dye-receiver element for use in a laser-induced thermal dye transfer system comprising:

a) coating a support with either:

1) a dye layer in a polymeric binder having an infrared absorbing material associated therewith, or 2) a dye image-receiving layer; said dye layer or said dye image-receiving layer also having spacer beads located either in said layer or in a polymeric overcoat layer; and b) heating said element at a temperature above the glass transition temperature of said dye layer or said dye image-receiving layer while under tension.

2. The process of claim 1 wherein said element is heated at 10°–20° C. above the glass transition temperature of said dye layer or said dye image-receiving layer while under tension.

3. The process of claim 1 wherein said web is heated while under a tension of about 350g/cm$^2$ to about 2500g/cm$^2$.

4. The process of claim 1 wherein spacer beads have a particle size ranging from about 3 to about 100 μm.

5. The process of claim 1 wherein the coverage of said spacer beads ranges from about 50 to about 100,000 beads/cm$^2$.

6. The process of claim 1 wherein said spacer beads have a particle size of from about 5 to about 50 μm and are present at a concentration of from about 60 to about 60,000/cm$^2$.

7. The process of claim 1 wherein said element is dried before heating step b).

* * * * *